US007136816B1

(12) United States Patent
Strom

(10) Patent No.: US 7,136,816 B1
(45) Date of Patent: Nov. 14, 2006

(54) SYSTEM AND METHOD FOR PREDICTING PROSODIC PARAMETERS

(75) Inventor: Volker Franz Strom, Jersey City, NJ (US)

(73) Assignee: AT&T Corp., New York, NY (US)

( * ) Notice: Subject to any disclaimer, the term of this patent is extended or adjusted under 35 U.S.C. 154(b) by 870 days.

(21) Appl. No.: 10/329,181

(22) Filed: Dec. 24, 2002

Related U.S. Application Data

(60) Provisional application No. 60/370,772, filed on Apr. 5, 2002.

(51) Int. Cl.
*G10L 13/08* (2006.01)

(52) U.S. Cl. ..... 704/260

(58) Field of Classification Search ..... None
See application file for complete search history.

(56) References Cited

U.S. PATENT DOCUMENTS

| | | | | |
|---|---|---|---|---|
| 4,695,962 | A * | 9/1987 | Goudie | 704/267 |
| 5,860,064 | A * | 1/1999 | Henton | 704/260 |
| 6,003,005 | A * | 12/1999 | Hirschberg | 704/260 |
| 6,163,769 | A * | 12/2000 | Acero et al. | 704/260 |
| 6,810,378 | B1 * | 10/2004 | Kochanski et al. | 704/258 |
| 6,978,239 | B1 * | 12/2005 | Chu et al. | 704/258 |
| 7,069,216 | B1 * | 6/2006 | DeMoortel et al. | 704/260 |
| 2002/0099547 | A1 * | 7/2002 | Chu et al. | 704/260 |

OTHER PUBLICATIONS

A. Syrdal and J. Hirschberg, "Automatic ToBI Prediction and Alignment to Speed Manual Labeling of Prosody", *Speech Communication, Special Issue on Speech Annotation and Corpus Tools*, No. 33, pp. 135-151, 2001.

A. Syrdal., "Inter-transcriber Reliability of ToBI Prosodic Labeling," in *Proc. Int. Conf. on Spoken Language Processing*, Beijing, 2000.

J. Hirschberg, "Pitch Accent in Context: Predicting Intonational Prominence from Context," in *Artificial Intelligence*, 1993, pp. 305-340.

A.P. Dempster, N.M. Laird, and D.B. Rubin, "Maximum Likelihood from Incomplete Data Via the EM Algorithm," *Journal of the Royal Statistical Society*, vol. 39, pp. 1-38, 1977.

V. Strom, "Detection of Accents, Phrase Boundaries and Sentence Modality in German with Prosodic Features," in *Proc. European Conf. on Speech Communication and Technology*, Madrid, 1995, vol. 3, pp. 2039-2041.

* cited by examiner

*Primary Examiner*—David D. Knepper

(57) ABSTRACT

A method for generating a prosody model that predicts prosodic parameters is disclosed. Upon receiving text annotated with acoustic features, the method comprises generating first classification and regression trees (CARTs) that predict durations and F0 from text by generating initial boundary labels by considering pauses, generating initial accent labels by applying a simple rule on text-derived features only, adding the predicted accent and boundary labels to feature vectors, and using the feature vectors to generate the first CARTs. The first CARTs are used to predict accent and boundary labels. Next, the first CARTs are used to generate second CARTs that predict durations and F0 from text and acoustic features by using lengthened accented syllables and phrase-final syllables, refining accent and boundary models simultaneously, comparing actual and predicted duration of a whole prosodic phrase to normalize speaking rate, and generating the second CARTs that predict the normalized speaking rate.

17 Claims, 3 Drawing Sheets

SYSTEM AND METHOD FOR PREDICTING PROSODIC PARAMETERS

PRIORITY CLAIM

The present application claims priority to U.S. Provisional Patent Application No. 60/370,772 filed Apr. 5, 2002, the contents of which are incorporated herein by reference.

BACKGROUND OF THE INVENTION

1. Field of the Invention

The present invention relates to text-to-speech generation and more specifically to a method for predicting prosodic parameters from preprocessed text using a bootstrapping method.

2. Discussion of Related Art

The present invention relates to an improved process for automating prosodic labeling in a text-to-speech (TTS) system. As is known, a typical spoken dialog service includes some basic modules for receiving speech from a person and generating a response. For example, most such systems include an automatic speech recognition (ASR) module to recognize the speech provided by the user, a natural language understanding (NLU) module that receives the text from the ASR module to determine the substance or meaning of the speech, a dialog management (DM) module that receives the interpretation of the speech from the NLU module and generates a response, and a TTS module that receives the generated text from the DM module and generates synthetic speech to "speak" the response to the user.

Each TTS system first analyzes input text in order to identify what the speech should sound like before generating an output waveform. Text analysis includes part-of-speech (P0S) tagging, text normalization, grapheme-to-phoneme conversion, and prosody prediction. Prosody prediction itself often consists of two steps: First, a symbolic description is generated, which indicates the locations of accents and prosodic phrase boundaries (or simply "boundaries"). More information regarding predicting accents and prosodic boundaries or pauses may be found in X. Huang, A. Acero, H. Hon, *Spoken Language Processing*, Prentice Hall, 2001, pages 739–782, incorporated herein by reference.

Frequently, the symbols used for prosody prediction are Tone and Break Indices ("ToBI") labels, which are also an abstract description of an F0 (fundamental frequency) contour. See, e.g., K. Silverman, M. Beckman, J. Pitrelli, M. Osterndorf C. Wightman, P. Price, I. Pierrehumbert, and I. Hirschberg, "Tobi: A standard for labeling English prosody," in *Proc. Int. Conf on Spoken Language Processing,* 1992, pp. 867–870, incorporated herein by reference. The second step involves using the ToBI labels to calculate numerical F0 values and phone durations. The rational behind this two-step approach is the belief that linguistic features are more strongly correlated with symbolic prosody than with the acoustic realization. This not only makes it easier for a human to write rules that predict prosody, it also makes it easier for a machine to learn these rules from a database.

Unfortunately, ToBI labeling is very slow and expensive. See, A. Syrdal and I. Hirschberg, "Automatic ToBI prediction and alignment to speed manual labeling of prosody," *Speech Communication, Special Issue on Speech Annotation and Corpus Tools,* 2001, no. 33, pp. 135–151. Having several labelers available may speed it up, but it does not address the cost factor and other issues such as inter-labeler inconsistency. Therefore, a more automatic procedure is highly desirable.

FIG. 1 illustrates a known method of prosody prediction using ToBI prediction and alignment. This method involves receiving speech files annotated with orthography (words and punctuation), pronunciation (phones and their duration, word and syllable boundaries, lexical stress and other parts of speech (102). Other linguistic features are added that are relevant to prosody such as "is a yes/no question?" (104). For each word or syllable, the method predicts symbolic prosody (e.g. ToBI) by applying a rule set such as a classification and regression tree (CART) (106). For each phone, the method predicts its duration by applying a rule set (108) and for each syllable, predicts parameters describing the syllable's F0 contour (110). Finally, from the contour parameters and phone duration, the method involves calculating the actual F0 contour (112).

Known prosody-prediction modules are based on a rule set that are manually written or generated according to machine learning techniques by adapting a few parameters to create all the rules. When the rules are derived from training data by applying machine learning methods, the training data needs to be labeled prosodically. The known method of labeling the training data prosodically is a manual process. What is needed in the art is a method of automating the process of creating prosodic labels without expensive, manual intervention.

SUMMARY OF THE INVENTION

The present invention addresses problems with known methods by enabling a method of creating prosodic labels automatically using an iterative approach. By analogy with automatic phonetic segmentation, which starts out with speaker-independent Hidden Markov Models ("HMMs") and then adapts them to a speaker in an iterative manner, the present invention relates to an automatic prosodic labeler. The labeler begins with speaker-independent (but language-dependent) prosody-predicting rules, and then turns into a classifier that iteratively adapts to the acoustic realization of a speaker's prosody. The refined prosodic labels in turn are used to train predictors for F0 targets and phone durations.

The present invention is disclosed in several embodiments, including a method of generating a prosodic model comprising a set of classification and regression trees (CARTs), a prosody model generated according to a method of iterative CART growing, and a computer-readable medium storing instructions for controlling a computer device to generate a prosody model.

According to an aspect of the invention, a method of generating a prosody model for generating synthetic speech from text-derived annotated speech files comprises (1) adding predicted linguistic features to text-derived annotations in the speech files, (2) adding normalized syllable durations to the annotations, (3) adding a plurality of extracted acoustic features to the annotations, (4) generating initial accent and boundary labels by considering pauses and relative syllable durations, (5) training CARTs to predict durations and F0s from the added predicted linguistic features and prosodic labels, (6) training refined CARTs to predict normalized durations, and (7) training a first classifier to label accents and boundaries.

Step 7 preferably comprises several other steps including (a) training a classifier (such as an n-next-neighborhood classifier) to recognize predicted accent and predicted boundary labels, (b) training the refined CARTs to output accent and boundary probabilities from linguistic features and relative syllable durations, and (c) relabeling the annotations. Next, the method comprises (8) training the refined CARTs to predict accents and boundaries from linguistic features only, (9) relabeling the annotations, and (10) returning to step (5) until prosodic labels stabilize.

Additional features and advantages of the invention will be set forth in the description which follows, and in part will be obvious from the description, or may be learned by practice of the invention. The features and advantages of the invention may be realized and obtained by means of the instruments and combinations particularly pointed out in the appended claims. These and other features of the present invention will become more fully apparent from the following description and appended claims, or may be learned by the practice of the invention as set forth herein.

BRIEF DESCRIPTION OF THE DRAWINGS

In order to describe the manner in which the above-recited and other advantages and features of the invention can be obtained, a more particular description of the invention briefly described above will be rendered by reference to specific embodiments thereof which are illustrated in the appended drawings. Understanding that these drawings depict only typical embodiments of the invention and are not therefore to be considered to be limiting of its scope, the invention will be described and explained with additional specificity and detail through the use of the accompanying drawings in which.

DETAILED DESCRIPTION OF THE INVENTION

Figure 1:
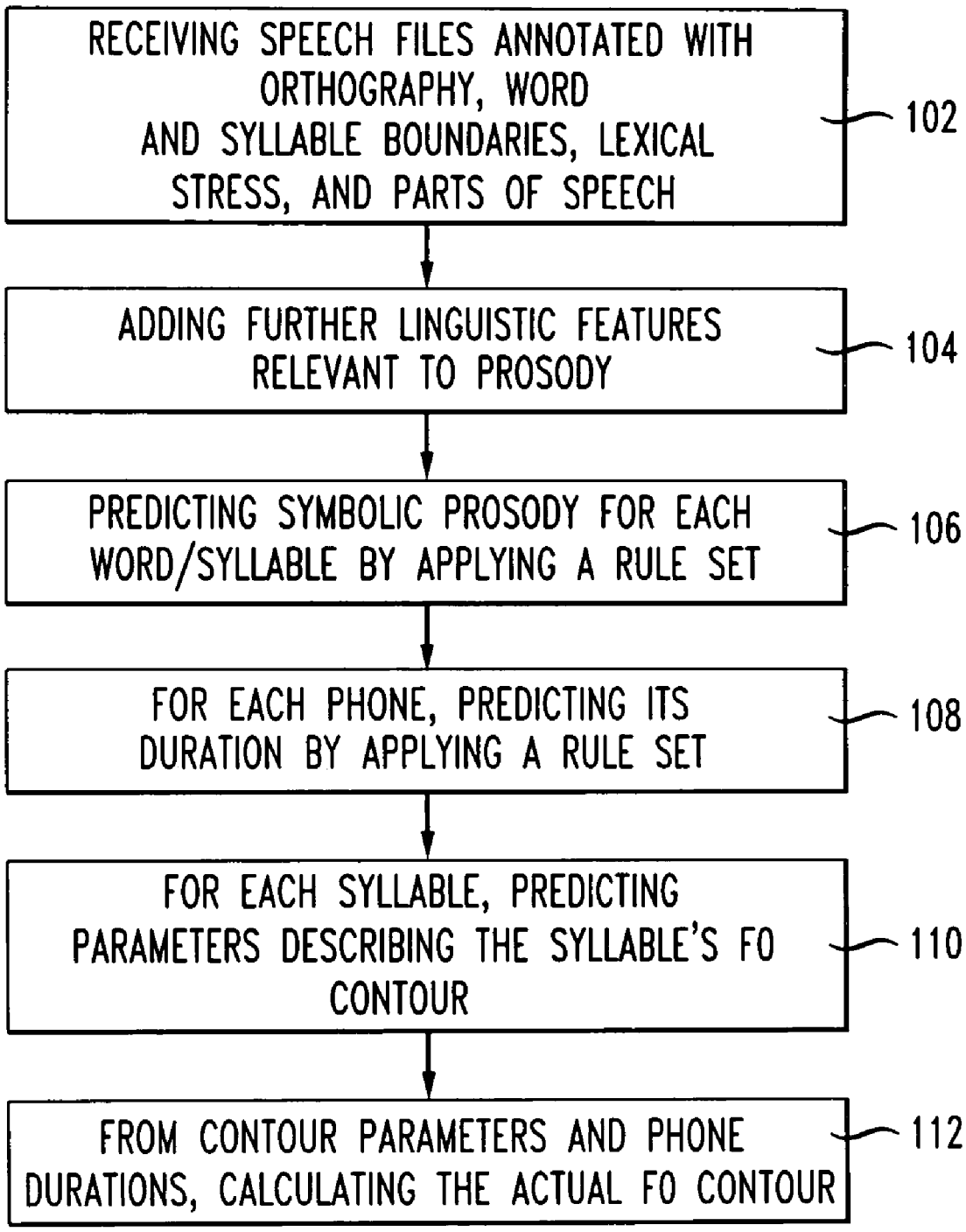
FIG. 1 PRIOR ART
FIG. 1. illustrates a state-of-the-art method of prosody prediction.

The present invention will be discussed with reference to the attached drawings. Several of the primary benefits as a result of practicing the present invention are: (1) the ability to drastically reduce the label set as compared to ToBI; (2) creating initial labels and exploiting the fact that all languages have prosodic phrase boundaries that are highly correlated with pauses, and both accented and phrase-final syllables tend to be lengthened; and (3) refining the labels by alternating between prosody prediction from text alone, and prosodic labeling of speech plus text.

A database is developed to train the prosody models. In a diphone synthesizer, there is only one or a few instances of each diphone which need to be manipulated in order to meet the specifications from the text analysis. In unit selection, a large database of phoneme units is searched for a sequence of units that meets the specifications best and, at the same time, keeps the joins as smooth as possible. Such a database typically consists of several hours of speech per voice. The speech is annotated automatically with words, syllables, phones, and some other features.

Such a database may be used to train the prosody models. To prepare the database for training prosody models, the annotations are enriched with punctuation, P0S tags, and F0 information. A TTS engine generates the P0S tags. The fundamental frequency F0 is estimated for each 10 ms frame, and interpolated in unvoiced regions. A contour results from the estimation and interpolation. From this resulting contour, three samples per syllable are taken, at the beginning, middle, and the end of the syllable; forming vectors of three F0 values each. From all vectors in the database, a plurality of prototypes (for example, thirteen may be extracted) is extracted through cluster analysis, representing thirteen different shapes of a syllable's F0 contour. All syllables in the database are labeled with the name of their closest prototype. Then a CART is trained to decide for the most likely prototype, given the syllable's linguistic features. During synthesis, this CART assigns a prototype name to each syllable. The corresponding syllable-initial, mid, and final F0 target replaces the name, and finally the targets are interpolated. The number of prototypes is a trade-off: a larger number allows for more accurate approximation of the real F0 contours, but the CART's problem to pick the right prototype gets harder, resulting in more prediction errors.

In an apparatus embodiment of the invention, software modules programmed to control a computer device perform these steps. The modules may be considered as a group an apparatus or a prosodic labeler for predicting prosodic parameters from annotated speech files, the automatic prosodic labeler comprising a first module that makes binary decisions about where to place accents and boundaries, a second module that predicts a plurality of fundamental frequency targets per syllable and that predicts a z-score for each phone, and a third module that labels speech with the binary decisions and that applies normalized duration features as acoustic features, wherein an iterative classification and regression tree (CART) growing process alternates between prosody prediction from text and prosody recognition from text plus speech to generate improved CARTs for predicting prosody parameters from preprocessed text.

The software modules may also control a computer device to perform further steps. For example, the first module may further comprise CARTs that generate initial accent and boundary labels by considering pauses and relative syllable durations, calculated from annotated speech files. The annotations relate to words, punctuation, pronunciation, word and syllable boundaries, and lexical stress. The prosodic labeler may add "acoustic" features to the annotations such as relative syllable durations and whether a syllable is followed by a pause. These features are obtained form the phonetic segmentation and by normalizing.

The prosodic labeler may also extract F0 contours from the annotated speech files, interpolate for unvoiced regions, take three samples per syllable, perform a cluster analysis, and add quantized F0s to the annotations. In addition, the prosodic labeler may perform the iterative CART growing process by: (1) adding predicted linguistic features to text-derived annotations in the speech files; (2) adding normalized syllable durations to the annotations; (3) adding a plurality of extracted acoustic features to the annotations; (4) generating initial accent and boundary labels by considering pauses and relative syllable durations; (5) training CARTs to predict durations and F0s from the added predicted linguistic features and prosodic labels; (6) training refined CARTs to predict normalized durations; (7) training a first classifier to label accents and boundaries by: (a) training an n-next-neighborhood classifier to recognize predicted accent and predicted boundary labels; (b) training the refined CARTs to output accent and boundary probabilities from linguistic features and relative syllable durations; (c) relabeling the annotations; (8) training the refined CARTs to predict accents and boundaries from linguistic features only; (9) relabeling the annotations; and (10) returning to step (5) until prosodic labels stabilize.

In an exemplary study, the inventor of the present invention used one American English female speaker database that had ToBI labels for 1477 utterances. The utterances were used to train a prosody recognizer. The automatically generated labels were used to train a first American English prosody model. In one aspect of the invention, the "prosody model" comprises four CARTs. Two Carts make binary decisions about where to place accents and boundaries. The other two CARTs predict three F0 targets per syllable, and for each phone its z-score (the z-score is the deviation of the phone duration from the mean as a multiple of the standard deviation). Further, in addition to the CARTs applied above, the two pairs of CARTs represent symbolic and acoustic prosody prediction respectively. They may be made by the free software tool "wagon", applying text-derived features. See A. Black, R. Caley, S. King, and P. Taylor, "CSTR software," http://www.cstr.ed.ac.uk/software. Other software tools for this function may also be developed in the future and applied. For labeling speech with the binary decisions, a different pair of CARTs applies additional normalized duration features as acoustic features.

Other rule-inducing algorithms may be used as equivalents to CARTs. For example, a rule-inducing algorithm that can deal directly with categorical features is based on the Extension Matrix theory, see, e.g., Wu, X. D, "Rule Induction with Extension Matrices," *Journal of the American Society for Information Science,* 1998. It is possible to replace a categorical feature by n-1 binary, i.e., numerical features, with n being the number of categories. For example, replace the phone feature "position within syllable" with three possible values "initial", "mid", and "final". One can replace them by 3 features "position is initial" " . . . is mid" and " . . . is final," with values 0 and 1 for "yes" and "no". Since the sum of them is always 1, it becomes possible to omit one feature. Once all features are numerical, one may apply any numerical classifier. Neural networks may also be used for prosody prediction.

A variety of features derived from text are used for prosody prediction. Some refer to words, such as P0S, or distance to sentence end. Other features may comprise sentence boundaries, whether the left word a content word and the right word a function word, whether there a comma at this location, and what is the length of the phrase? Others refer to syllables, such as stress, or whether the syllable should be accented. For phone duration prediction, additional features refer to phones, for example their phone class or position within the syllable.

Some features are simple, others more complex, such as the "given/new feature" feature. This feature involves lemmatizing the content words and adding them to a "focus stack." See, e.g., 1. Hirschberg, "Pitch accent in context: predicting intonational prominence from context," in *Artificial Intelligence,* 1993, pp. 305–340. Lemmatizing means replacing a word by its base form, such as replacing the word "went" with "go." The focus stack models explicit topic shift; a word is considered "given", if it is already in this stack.

As opposed to more traditional approaches, the binary symbolic prosodic decisions are only two of many features for predicting acoustic prosody: the CART-growing algorithm determines if and when the accent feature is considered for predicting the z-score of a specific phone. This way hard decisions on the symbolic level are avoided.

Some CART-growing algorithms have problems with capturing dependencies between features. Breiman et al. suggest combining related features into new features. However, trying all possible feature combinations leads to far too many combined features. See L. Breiman, I. Friedman, R. Olshen, and C. Stone, "Classification and regression trees," *Boca Raton,* 1984. Providing too many features with most of them correlated often worsens the performance of the resulting CART. A common countermeasure is to wrap CART growing into a feature pre-selection, but with larger numbers of features this quickly becomes too expensive. The inventor of the present invention prefers to offer the feature selection only those relevant combinations suggested in the literature or based on intuition that address the most serious problems.

The final F0 rise in yes/no-questions posed one such problem. Even though the feature set included the punctuation mark, the sentence-initial parts-of-speech (POS), and whether the sentence contains an "or" (since in alternative questions, the F0 rises at the end of the first alternative, not at sentence end), the CART-growing algorithm was not able to create an appropriate sub tree. This was partly to the sparseness of yes/no-question-final syllables, but even adding copies of did not help. Wagon needed an explicit binary feature "yes-no question" in order to get question prosody right.

While CARTs are an obvious way to deal with categorical features, most CART-growing algorithms cannot really deal with numerical features. Considering all possible splits (f<c) is impractical since for each feature f there are up to as many as observed feature values c. Wagon splits the feature value range in n intervals of equal size. But this kind of quantization may be corrupted by a single outlier. Cluster analysis and vector quantization up front is the inventor's preferable solution in this case.

From the set of F0 vectors (three F0 samples per syllable), approximately a dozen clusters are identified by Lloyd's algorithm. See P. Lloyd, "Least squares quantization in PCM," in *IEEE Trans. on Inf. Theory,* 1982, vol. 28, pp. 129–137. The F0 target predictor's task is to predict the cluster index, which in turn is replaced by the centroid vector. The centroid vectors can be seen as prototypes for F0 contours of a syllable. The number of clusters is a trade-off between quantization error and prediction accuracy. It is also important to cover rare but important cases, e.g. the final rise in yes-no questions. This can be done by equalizing the training data.

The basic idea in iterative CART growing is to alternate between prosody prediction from text and prosody recognition from text plus speech. To that end, it is a special case of the Expectation Maximization algorithm. See, e.g., A. R. Dempster, N. M. Laird, and D. B. Rubin, "Maximum likelihood from incomplete data via the EM algorithm," *Journal of the Royal Statistical Society*, vol. 39, pp. 1–38, 1977.

Figure 2:
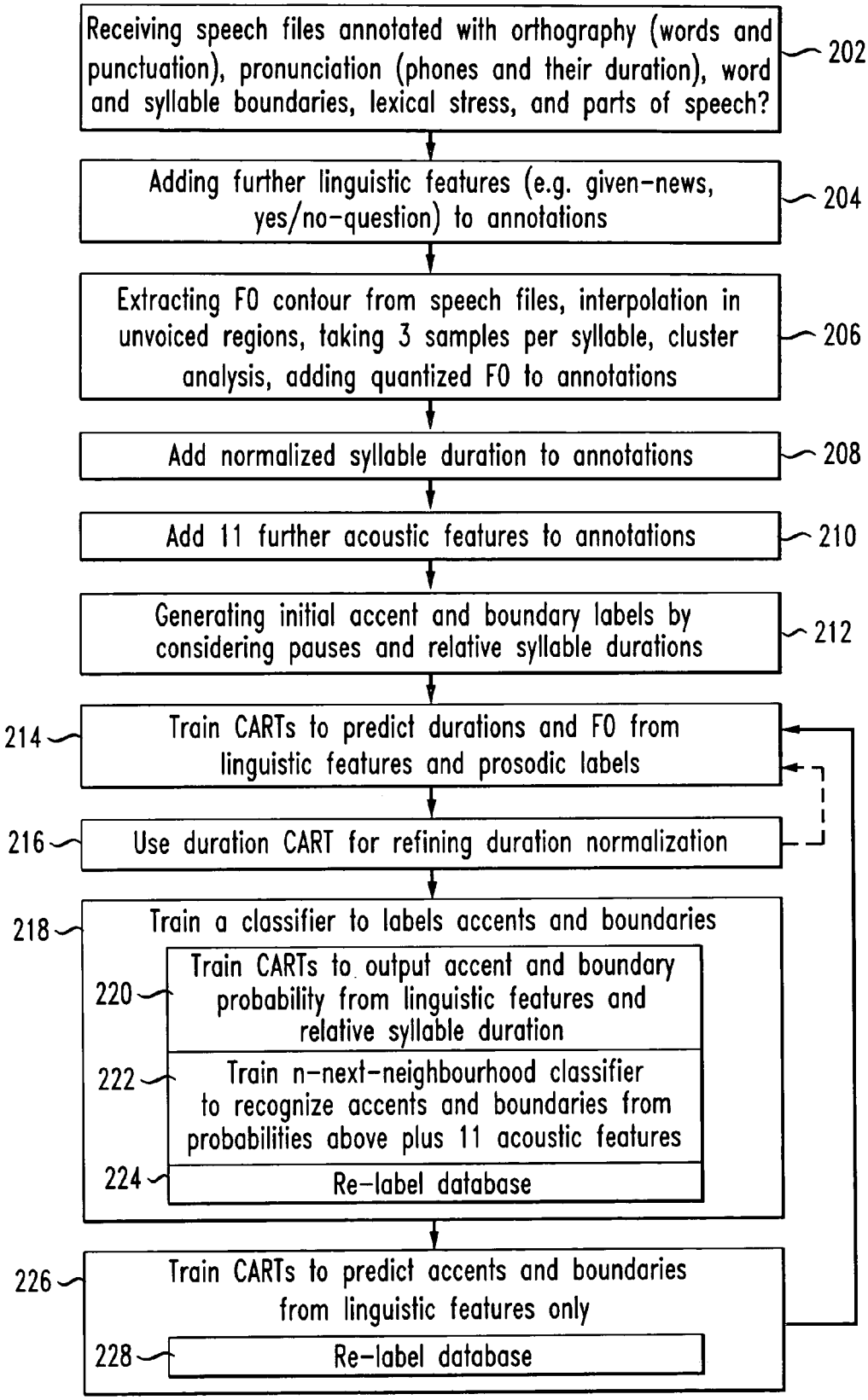
FIG. 2 illustrates a method of automatically creating prosodic labels and rule sets (CARTs) for predicting and labeling prosody.

FIG. 2 illustrates an exemplary method according to an aspect of the present invention. The preferred method uses CARTs but the terms predictors and labelers are also used. The method comprises receiving text annotated with orthography such as word and punctuation, pronunciation (phones and their duration), word and syllable boundaries, lexical stress, and parts of speech (202); adding further linguistic features such as given-new, yes/no-question to the annotations (204); extracting an F0 contour from speech files, interpolating in unvoiced regions, taking three samples per syllable, performing a cluster analysis, and adding quantized F0 to the annotations (206); adding normalized syllable duration to the annotations (208); adding a plurality (preferably eleven) further acoustic features to the annotations (210); generating initial accent and boundary labels by considering pause and relative syllable durations (212); training CARTs (or predictors and labelers) to predict durations and F0 from linguistic features and prosodic labels (214); using a duration CART (or predictor and labeler) for refining duration normalization (216); training a classifier to label accents and boundaries (218) by:

(1) training a classifier (for example, an n-next-neighborhood classifier) to recognize accents and boundaries from probabilities plus the eleven acoustic features (220);

(2) training CARTs to output accent and boundary probablility from linguistic features and relative syllable duration (222); and (3) relabeling the database (224); and training CARTs to predict accents and boundaries from linguistic features only (226); and relabeling the database (228). Finally, the iterative process involves returning to step 214 to retrain the CARTs to predict durations and F0 from the linguistic features and prosodic labels. Following step 216, an optional approach is to return to step 214 and remake the duration CART.

Initial accent and boundary labels are obtained by simple rules: Each longer pause is considered a boundary, as well as each sentence boundary (most of which coincide with a pause). ToBI hand labels for a large corpus of one female American English speaker suggest that boundaries and pauses are highly correlated. As far as accents are concerned, an aspect of the invention prefers to initialize the iteration with a speaker-independent accent recognizer, as it is the case with the simple boundary recognizer. Acoustic cues for accents are less strong, and some are similar to cues for boundaries Initial accent labels are created by the following rule: A syllable is accented if it carries lexical stress, belongs to a content word, and its relative duration is above a threshold. The threshold for phrase-final syllables is larger since speakers tend to lengthen phrase-final syllables. The threshold is chosen so that every nth word will be labeled as accented. The number n is language-dependent and heuristically chosen. The relative duration of a syllable is its actual duration—obtained from automatic phonetic segmentation—divided by its predicted duration. In this initial stage, the predicted duration is simply the sum of its phone's mean durations. This statistic is also obtained from automatic phonetic segmentation.

After the speaker's speech is recorded, the speech is stored in audio files, and the system has the text the speaker read. "Phonetic segmentation" means marking the boundaries of all phones, or "speech sounds", including the pauses. This is done with a speech recognizer in "forced recognition mode", i.e. the recognizer knows what it has to recognize, and the problem is reduced to time aligning the phones.

The predicted accent and boundary labels are added to the feature vectors (210), just as additional features. Of the feature vectors used for training the CART that can predict an F0 contour for a syllable, each one consists of the name of the syllable's F0 contour prototype, the syllable's linguistic features, and the syllable's accent and boundary labels as two binary features. Of the feature vectors used for training the CART that can predict the duration of a phone, each one consists of the actual duration of a phone, the phone's linguistic features, and the accent and boundary label of the syllable it belongs to. F0 and duration predicting CARTs made from this data often produce better sounding prosody, probably because they are inherently speaker-adaptive. Generating CARTs from the data is accomplished by feeding the feature vectors into a CART-growing program. Such programs are known in the art.

Once CARTs exist that predict durations and F0 from text, these models can be used to refine the accent and boundary labels. When making the initial accent labels, the F0 contour was not taken into account, and syllable duration prediction consisted of simply summing up average phone durations. Now phone durations can be predicted more accurately, since the CART considers phone context, lexical stress and other linguistic features (214). This in turn allows for more accurate calculation of the relative duration of each syllable in the database, again as the ratio between its actual duration and the sum of its phone's predicted durations. Relative syllable duration is an important acoustic cue for accents and boundaries, across all speakers and all languages. Accented syllables as well as phrase-final syllables are typically longer in duration. Thus, accent and boundary models must be refined simultaneously. The amount of lengthening is determined by the ratio of actual and predicted duration.

In the same manner, the actual and predicted duration of a whole prosodic phrase can be compared, which allows for some degree of speaking rate normalization. Assuming that speaking rate changes from phrase to phrase only, and that the durations predicted by the CART reflect an average speaking rate, for each phrase a speaking rate is calculated as the ratio between actual and predicted duration. Then the durations of all phones in this phrase are divided by the speaking rate, yielding phone durations that are normalized with respect to speaking rate. A new CART is grown that predicts these normalized durations. This CART poses as an even better model for the average speaking rate, and can be used for yet another speaking rate normalization.

The next iteration step as set forth above is to train a classifier that re-labels the entire database prosodically, i.e., with accents and boundaries (218). The classifier looks on both textual and acoustic features, as opposed to a prosody predictor, which looks at textual features only. The acoustic features include not only improved durations as described above, but eleven further features as described below. The prosodic labels used for training are the initial labels, or, later in the iteration, the labels resulting from the previous step. The classifier then re-labels the entire database (224). These labels are input to the next iteration step: growing prosody-predicting CARTs based on textual features only, and re-labeling the database again (228).

As referenced in step (210), preferably eleven further acoustic features are extracted from each speech signal frame: three median-smoothed energy bands derived from the short time Fast Fourier Transformation make the energy features. The interpolated F0 contour (one value per signal frame) is decomposed into three components with band pass filters. For each frame, the F0, their three components, and the time derivatives of them make eight F0 features that describe the F0 contour locally and globally. When it comes to classify a syllable or syllable boundary, the features of the signal frame closest to the syllable nucleus mid or syllable boundary are taken.

A classifier is trained to recognize the accent and boundary labels predicted in the previous step (214). With a mixed set of features, the problem is that CARTs cannot really handle numeric features, and numerical classifiers cannot really deal with categorical features. A categorical feature can be transformed to a set of numerical features of the form "feature value is X" with 1 for "yes" and 0 for "no". Conversely, a numerical feature can be converted to a categorical feature by vector quantization: A cluster analysis is performed on a large number of feature values, and then each future feature value is replaced by the name of its closest cluster centroid. However, a hierarchic classifier is preferably employed in the present invention: Two CARTs that predict accents and boundaries from textual features are operated in a mode so they do not output the class having the highest posteriori probability, but the probability itself. The probabilities for accent and for boundary are added to the acoustic features as condensed and numerical linguistic features. An n-next-neighborhood classifier preferably does the final classification but the selection of whether to user classification trees and next-neighborhood classifiers as predictors and labelers is not relevant to the invention.

The machine labels are then fed into the next iteration step of growing prosody-predicting CARTs. With the speakers discussed herein, the created prosodic labels stabilized quickly during the iteration. In some cases, only two iterations may be required but the inventor contemplates that for various speakers, more iteration may be needed given the circumstances. For example, a German male speaker paused at places where one would normally not pause. This resulted in initial boundary labels that were too difficult to predict from text. A reasonable CART for the German female speaker already existed and may be substituted for the first iteration if necessary.

Figure 3:
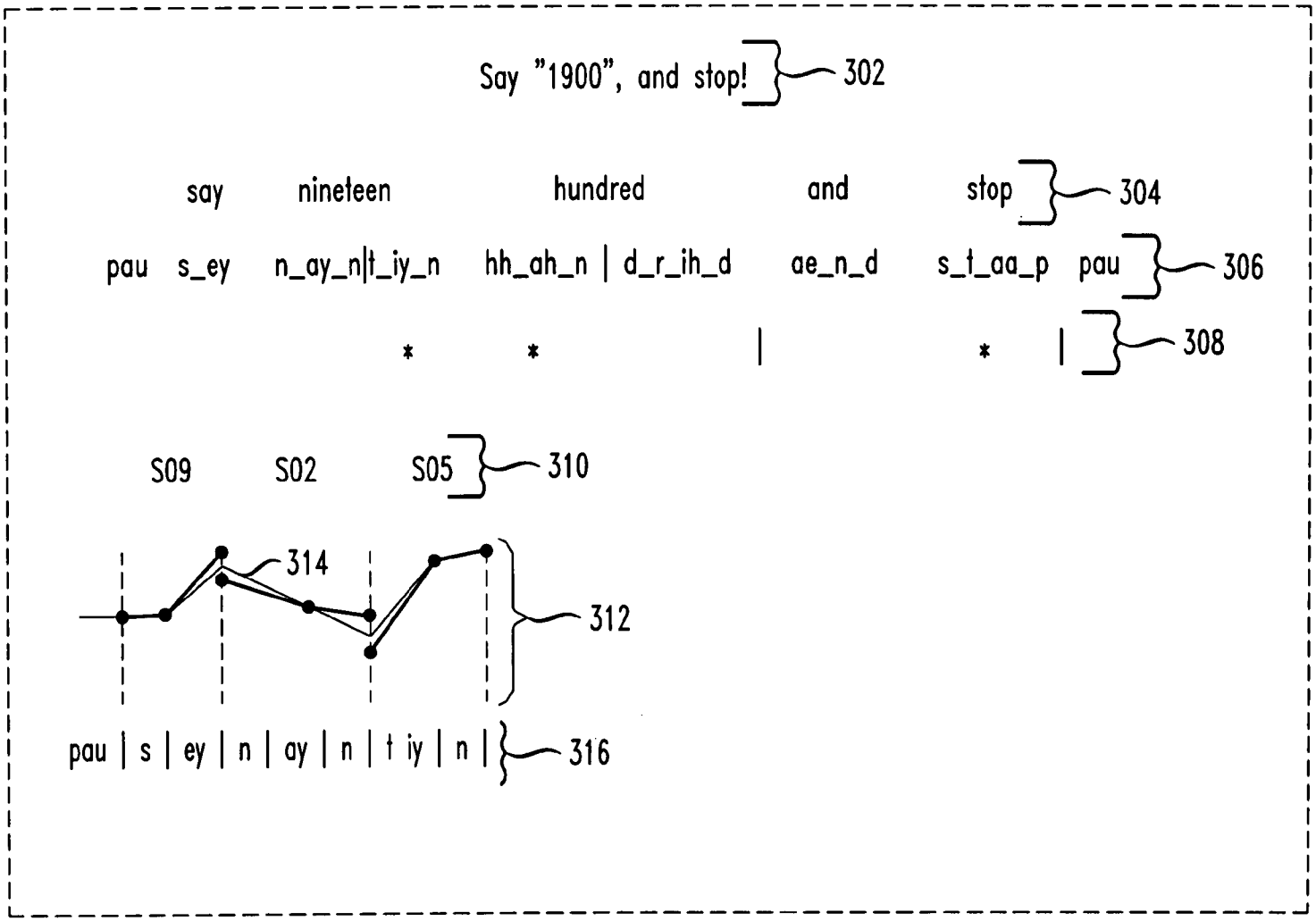
FIG. 3 illustrates the process of generating an F0 contour.

FIG. 3 illustrates the method of predicting prosody parameters. In this example, the input text 302 is "Say '1900' and stop!" The normalized text 304 is shown as "say nineteen hundred and stop." The system processes the normalized text to generate a set of phones 306; in this example, they are: "pau s_ey n_ay_n | t_iy_n hh_ah_n | d_r_ih_d ae_n_d s_t_aa_p pau." The symbols "*" and "|" shown in FIG. 3 illustrate predicted positions of accents and boundaries respectively. From this information, the system predicts F0 contours 310, and 1 of 13 shape names per syllable are predicted. Graph 312 illustrates the shape name decoded into 3 F0 values that are aligned to each syllable initial, mid and final position. This occurs after the phone duration prediction. The final interpolation 314 is shown along with the predicted phone durations 316 for the phrase "say nineteen."

Embodiments within the scope of the present invention may also include computer-readable media for carrying or having computer-executable instructions or data structures stored thereon. Such computer-readable media can be any available media that can be accessed by a general purpose or special purpose computer. By way of example, and not limitation, such computer-readable media can comprise RAM, ROM, EEPROM, CD-ROM or other optical disk storage, magnetic disk storage or other magnetic storage devices, or any other medium which can be used to carry or store desired program code means in the form of computer-executable instructions or data structures. When information is transferred or provided over a network or another communications connection (either hardwired, wireless, or combination thereof) to a computer, the computer properly views the connection as a computer-readable medium. Thus, any such connection is properly termed a computer-readable medium. Combinations of the above should also be included within the scope of the computer-readable media.

Computer-executable instructions include, for example, instructions and data which cause a general purpose computer, special purpose computer, or special purpose processing device to perform a certain function or group of functions. Computer-executable instructions also include program modules that are executed by computers in stand-alone or network environments. Generally, program modules include routines, programs, objects, components, and data structures, etc. that perform particular tasks or implement particular abstract data types. Computer-executable instructions, associated data structures, and program modules represent examples of the program code means for executing steps of the methods disclosed herein. The particular sequence of such executable instructions or associated data structures represents examples of corresponding acts for implementing the functions described in such steps.

Those of skill in the art will appreciate that other embodiments of the invention may be practiced in network computing environments with many types of computer system configurations, including personal computers, hand-held devices, multi-processor systems, microprocessor-based or programmable consumer electronics, network PCs, mini-computers, mainframe computers, and the like. Embodiments may also be practiced in distributed computing environments where tasks are performed by local and remote processing devices that are linked (either by hardwired links, wireless links, or by a combination thereof) through a communications network. In a distributed computing environment, program modules may be located in both local and remote memory storage devices.

Although the above description may contain specific details, they should not be construed as limiting the claims in any way. Other configurations of the described embodiments of the invention are part of the scope of this invention. For example, any electronic communication between people where an animated entity can deliver the message is contemplated. Email and instant messaging have been specifically mentioned above, but other forms of communication are being developed such as broadband 3G and 4G wireless technologies wherein animated entities as generally described herein may apply. Accordingly, the appended claims and their legal equivalents should only define the invention, rather than any specific examples given.

I claim:

1. An automatic prosodic labeler for predicting prosodic parameters from annotated speech files, the automatic prosodic labeler comprising:

a first module that makes binary decisions about where to place accents and boundaries;

a second module that predicts a plurality of fundamental frequency targets per syllable and that predicts a z-score for each phone; and a third module that labels speech with the binary decisions and that applies normalized duration features as acoustic features, wherein an iterative classification and regression tree (CART) growing process alternates between prosody prediction from text and prosody recognition from text plus speech to generate improved CARTs for predicting prosody parameters from preprocessed text.

2. The prosodic labeler of claim 1, wherein the first module comprises CARTs that generate initial accent and boundary labels by considering pauses and relative syllable durations.

3. The prosodic labeler of claim 2, wherein the second module comprises CARTs that predict three F0 targets per syllable.

4. The prosodic labeler of claim 2, wherein the first module further makes initial accent labels applying a simple rule on text-derived features only.

5. The prosodic labeler of claim 1, wherein the third module further comprises CARTs.

6. The prosodic labeler of claim 1, wherein pause durations and syllable durations, obtained from phonetic segmentation and normalization, are added to textual features in the annotated speech files.

7. The prosodic labeler of claim 1, wherein the annotations in the annotated speech files relate to words, punctuation, pronunciation, word and syllable boundaries, lexical stress and parts of speech.

8. The prosodic labeler of claim 7, wherein the prosodic labeler extracts F0 contours from the annotated speech files, interpolates for unvoiced regions, takes three samples per syllable, performs a cluster analysis, and adds quantized F0s to the annotations.

9. The prosodic labeler of claim 1, wherein the iterative CART growing process further comprises:

(1) adding predicted linguistic features to text-derived annotations in the speech files;

(2) adding normalized syllable durations to the annotations;

(3) adding a plurality of extracted acoustic features to the annotations;

(4) generating initial accent and boundary labels by considering pauses and relative syllable durations;

(5) training CARTs to predict durations and F0s from the added predicted linguistic features and prosodic labels;

(6) training refined CARTs to predict normalized durations;

(7) training a first classifier to label accents and boundaries by:

(a) training an n-next-neighborhood classifier to recognize predicted accent and predicted boundary labels;

(b) training the refined CARTs to output accent and boundary probabilities from linguistic features and relative syllable durations;

(c) relabeling the annotations;

(8) training the refined CARTs to predict accents and boundaries from linguistic features only;

(9) relabeling the annotations; and

(10) returning to step (5) until prosodic labels stabilize.

10. A method of generating a prosody model for generating synthetic speech from text-derived annotated speech files, the method comprising:

(1) adding predicted linguistic features to text-derived annotations in the speech files;

(2) adding normalized syllable durations to the annotations;

(3) adding a plurality of extracted acoustic features to the annotations;

(4) generating initial accent and boundary labels by considering pauses and relative syllable durations;

(5) training CARTs to predict durations and F0s from the added predicted linguistic features and prosodic labels;

(6) training refined CARTs to predict normalized durations;

(7) training a first classifier to label accents and boundaries by:

(a) training a classifier to recognize predicted accent and predicted boundary labels;

(b) training the refined CARTs to output accent and boundary probabilities from linguistic features and relative syllable durations;

(c) relabeling the annotations;

(8) training the refined CARTs to predict accents and boundaries from linguistic features only;

(9) relabeling the annotations; and

(10) returning to step (5) until prosodic labels stabilize.

11. The method of claim 10, further comprising, to generate the plurality of extracted acoustic features:

extracting F0 contours from the annotated speech files;

interpolating in unvoiced regions;

taking three samples per syllable;

performing a cluster analysis; and adding quantized F0s to the annotations.

12. The method of claim 11, wherein the cluster analysis is performed to obtain a plurality of prototypes representing different shapes of the F0 contours.

13. The method of claim 10, wherein the added linguistic features relate to a yes-no question.

14. The method of claim 10, wherein the annotations in the annotated speech files comprise words, punctuation, pronunciation, word and syllable boundaries, lexical stress and parts-of-speech.

15. The method of claim 11, wherein the plurality of extracted features comprises eleven extracted features.

16. The method of claim 10, further comprising, after step (6), optionally returning to step (5) to remake the CARTs.

17. A computer readable medium storing instructions for controlling a computer device to perform a method of generating a prosody model from text-derived annotated speech files for use in prosody prediction, the method comprising:

(1) adding predicted linguistic features to text-derived annotations in the speech files;

(2) adding normalized syllable durations to the annotations;

(3) adding a plurality of extracted acoustic features to the annotations;

(4) generating initial accent and boundary labels by considering pauses and relative syllable durations;

(5) training CARTs to predict durations and F0s from the added predicted linguistic features and prosodic labels;

(6) training refined CARTs to predict normalized durations;

(7) training a first classifier to label accents and boundaries by:

(a) training a classifier to recognize predicted accent and predicted boundary labels;

(b) training the refined CARTs to output accent and boundary probabilities from linguistic features and relative syllable durations;

(c) relabeling the annotations;

(8) training the refined CARTs to predict accents and boundaries from linguistic features only;

(9) relabeling the annotations; and

(10) returning to step (5) until prosodic labels stabilize.

* * * * *